US007802934B2

(12) United States Patent
Mushimoto

(10) Patent No.: US 7,802,934 B2
(45) Date of Patent: Sep. 28, 2010

(54) IMAGE GENERATING APPARATUS HAVING AXIALLY MOVABLE ROLLER GEAR

(75) Inventor: Atsushi Mushimoto, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 605 days.

(21) Appl. No.: 11/808,745

(22) Filed: Jun. 12, 2007

(65) Prior Publication Data

US 2007/0292188 A1 Dec. 20, 2007

(30) Foreign Application Priority Data

Jun. 15, 2006 (JP) ..... 2006-165640

(51) Int. Cl.
*B41J 15/00* (2006.01)

(52) U.S. Cl. ..... 400/613; 400/615.2; 400/636

(58) Field of Classification Search ..... 400/613
See application file for complete search history.

(56) References Cited

U.S. PATENT DOCUMENTS 4,930,916 A * 6/1990 Fujiwara ..... 400/636
4,976,558 A * 12/1990 Kuzuya et al. ..... 400/615.2
5,011,313 A * 4/1991 Sato ..... 400/605
5,655,206 A 8/1997 Miyazawa
6,042,280 A * 3/2000 Yamaguchi et al. .... 400/120.16
2003/0081977 A1* 5/2003 Carriere et al. ..... 400/613

FOREIGN PATENT DOCUMENTS

JP 5-17040 A 1/1993
JP 6-106796 A 4/1994
JP 8-169574 A 7/1996
JP 2000-318257 A 11/2000
JP 2004-054169 A 2/2004

* cited by examiner

*Primary Examiner*—Jill E Culler
(74) *Attorney, Agent, or Firm*—Crowell & Moring LLP

(57) ABSTRACT

An image generating apparatus includes a rotatable roller for carrying a paper, provided movably in an axial direction, a roller gear fixedly mounted on the roller, a drive gear meshing with the roller gear and driven by a driving source, and a position adjustment member regulating an axial position of the roller gear so as to hold the roller gear from axial both sides while capable of moving the roller gear to a separate position for separating the roller gear and the drive gear from each other in a state of applying no pressing force to the roller gear and to a mesh position for meshing the roller gear and the drive gear with each other in carrying the paper.

17 Claims, 6 Drawing Sheets

IMAGE GENERATING APPARATUS HAVING AXIALLY MOVABLE ROLLER GEAR

BACKGROUND OF THE INVENTION

1. Field of the Invention

The present invention relates to an image generating apparatus, and more particularly, it relates to an image generating apparatus comprising a rotatable roller for carrying a paper.

2. Description of the Background Art

An image generating apparatus comprising a rotatable roller for carrying a paper is known in general, as disclosed in Japanese Patent Laying-Open Nos. 5-17040 (1993), 8-169574 (1996), 6-106796 (1994), 2004-54169, and 2000-318257, for example. These documents disclose a mechanism allowing transmission of driving force of a motor to a roller in a printing operation and free rotation of the roller in a nonprinting operation (during maintenance of the roller or paper jam).

The image generating apparatus described in the aforementioned Japanese Patent Laying-Open No. 5-17040 comprises a rotatable reverse roller (roller), a backing plate fixedly mounted on the reverse roller, a drive gear rotating following driving force of a driving source, a driven gear (roller gear) meshing with the drive gear, a pin for transmitting rotation of the driven gear to the reverse roller, a helical compression spring mounted between the driven gear and the backing plate, a slide lever for sliding the driven gear in a direction of axis of rotation. In the aforementioned Japanese Patent Laying-Open No. 5-17040, the driven gear is slid in a direction to go counter to urging force of the helical compression spring by an operation of the slide lever and the driven gear moves to a position for separating from the drive gear.

The image generating apparatus described in the aforementioned Japanese Patent Laying-Open No. 8-169574 comprises an idler gear (drive gear) rotated due to driving force of the driving source, a gear (roller gear) meshing with the idler gear, a paper feed roll shaft mounted with a gear and a paper feed roll (roller), a slidable bearing member, a bearing stop member stopping the bearing member, a spring member urging the bearing member toward the bearing stop member, a lever arranged between the bearing member and the bearing stop member, and two E-shaped rings for regulating an axial position of the paper feed roll. In the aforementioned Japanese Patent Laying-Open No. 8-169574, the bearing member is slid in a direction to separate from the bearing stop member by the lever, thereby releasing a stop state of the bearing member by the bearing stop member. Thus, the paper feed roll shaft can be detached.

The image generating apparatus described in the aforementioned Japanese Patent Laying-Open No. 6-106796 comprises a rotatable paper feed roller (roller), a paper feed roller gear (roller gear) mounted on the paper feed roller, a drive motor for driving the paper feed roller gear, a motor gear (drive gear) of the drive motor, a slidable slide gear, a helical compression spring for urging the slide gear in a first direction, and a lever for sliding the slide gear. In the aforementioned Japanese Patent Laying-Open No. 6-106796, the slide gear is slid to a mesh position for meshing with the motor gear and the paper feed roller gear and a separate position for separating the slide gear from the motor gear and the paper feed roller gear by an operation of the lever, thereby switching between a state in which driving force of the drive motor is transmitted to the paper feed roller gear and a state in which the same is not transmitted to the paper feed roller gear.

The image generating apparatus described in the aforementioned Japanese Patent Laying-Open No. 2004-54169 comprises a driven gear (drive gear) transmitting driving force of the drive motor, a roller gear mounted on a roller, a slidable slide gear arranged between the driven gear and the roller gear, a spring member urging the slide gear toward the roller gear, and a lever for sliding the slide gear to a mesh position at which the slide gear meshes with both the roller gear and the driven gear and a separate position at which the slide gear meshes with the driven gear only. In the aforementioned Japanese Patent Laying-Open No. 2004-54169, the slide gear is moved to the separate position by the lever, whereby the mesh between the slide gear and the roller gear is released to allow free rotation of the roller.

The image generating apparatus described in the aforementioned Japanese Patent Laying-Open No. 2000-318257 comprises a roller shaft mounted with the platen roller (roller), a roller gear mounted on a first end of the roller shaft, a motor gear (drive gear) transmitting driving force of the motor while meshing with the roller gear, a support portion provided for supporting both ends of the roller shaft and having opening on an upper side, a drop preventing member mounted on a second end of the roller shaft and regulating axial movement of the roller shaft, a hooked member located below the first end of the roller shaft, a lever for swinging the hooked member upward and downward, and a pick-up pin for fixing a position of the lever. In the aforementioned Japanese Patent Laying-Open No. 2000-318257, the hooked member is swung upward by an operation of the lever, thereby lifting the first end of the roller shaft upward. Thus, the mesh between the roller gear and the motor gear is released to allow free rotation of the platen roller. The lever is fixed above the pick-up pin.

In the aforementioned Japanese Patent Laying-Open No. 5-17040, however, the backing plate holding the helical compression spring for urging the driven gear between the compression spring and the driven gear, and the pin capable of moving the driven gear in the axial direction with respect to the shaft and rotating the same together with the shaft are required as a mechanism for switching so as to freely rotate the reverse roller (roller), separately from the reverse roller (roller), the drive gear, the driven gear (roller gear) and the slide lever, whereby the number of components is disadvantageously increased. Additionally, the driven gear is pressed by the helical compression spring and the slide lever in a state where the driven gear is separated from the drive gear, whereby the reverse roller (roller) is disadvantageously difficult to be smoothly rotated.

In the aforementioned Japanese Patent Laying-Open No. 8-169574, the bearing member and the two E-shaped rings are required for regulating the position of the paper feed roll in paper carriage as a mechanism for detaching the paper feed roll separately from the driving source, the idler gear (drive gear), the gear (roller gear) and the lever, whereby the number of components is disadvantageously increased.

In the aforementioned Japanese Patent Laying-Open Nos. 6-106796 and 2004-54169, the slide gear for transmitting or blocking the driving force of the drive motor must be separately provided as a mechanism for switching so as to freely rotate the roller, whereby the number of components is disadvantageously increased.

In the aforementioned Japanese Patent Laying-Open No. 2000-318257, the drop preventing member regulating the axial movement of the roller shaft and the roller gear in paper carriage must be provided as a mechanism for switching so as to freely rotate the platen roller (roller), separately from the roller gear, the motor gear (drive gear) transmitting the driving force of the motor and the lever, whereby the number of components is disadvantageously increased.

SUMMARY OF THE INVENTION

The present invention has been proposed in order to solve the aforementioned problems, and an object of the present invention is to provide an image generating apparatus capable of switching between a free rotation state allowing smooth free rotation of a roller and a transmission state to transmit driving force of a drive gear while inhibiting the number of components from increase.

An image generating apparatus according to a first aspect of the present invention comprises a rotatable roller for carrying a paper, provided movably in an axial direction, a roller gear fixedly mounted on the roller, a drive gear meshing with the roller gear and driven by a driving source, and a position adjustment member regulating an axial position of the roller gear so as to hold the roller gear from axial both sides, while capable of moving the roller gear to a separate position for separating the roller gear and the drive gear from each other in a state of applying no pressing force to the roller gear and to a mesh position for meshing the roller gear and the drive gear with each other in carrying the paper.

In the image generating apparatus according to the first aspect, as hereinabove described, the position adjustment member regulating the axial position of the roller gear so as to hold the roller gear from the axial both sides while capable of moving the roller gear to the separate position for separating the roller gear and the drive gear from each other and to the mesh position for meshing the roller gear and the drive gear with each other in carrying the paper is provided, whereby the movement of the position adjustment member enables switching between a free rotation state allowing free rotation in cleaning the roller and a transmission state to transmit the driving force of the drive gear in carrying the paper. The roller gear and the drive gear are separated from each other in a state of applying no pressing force to the roller gear, thereby allowing smooth free rotation of the roller in cleaning the roller. Additionally, the position adjustment member regulates the axial position of the roller gear so as to hold the roller gear from the axial both sides, whereby a member for regulating the axial movement of the roller and the roller gear in carrying the paper, such as an E-shaped ring or a drop preventing member, may not be separately provided. The roller gear can be moved in both axial directions by moving this position adjustment member, whereby a spring member for urging the roller gear or the like may not be provided. The roller gear can be moved to the separate position or the mesh position due to the movement of the position adjustment member, whereby a slide gear for transmitting or blocking the driving force of the drive motor may not be separately provided. Thus, the number of components can be inhibited from increase.

The aforementioned image generating apparatus according to the first aspect preferably further comprises a spring member for inhibiting the position adjustment member from moving from the separate position or the mesh position. According to this structure, the state of separating the roller gear and the drive gear from each other or the state of meshing the roller gear and the drive gear with each other can be stably held.

The aforementioned image generating apparatus according to the first aspect preferably further comprises a housing, wherein the position adjustment member preferably includes a body set inside the housing and allowing movement of the roller gear and an operating portion set outside the housing and to be operated by an operator. According to this structure, the body can be moved due to the operation of the operating portion from the outside of the housing by the operator. Thus, the roller gear can be easily moved.

In this case, the operating portion preferably includes an operating plate to be gripped by the operator. According to this structure, the roller gear can be easily moved due to the operation of the operating plate from the outside of the housing by the operator.

In the aforementioned structure comprising the housing, the housing is preferably provided with an L-shaped hole, the position adjustment member is preferably movable vertically and horizontally along the L-shaped hole, and first and second ends of the L-shaped hole preferably correspond to the separate position and the mesh position respectively. According to this structure, the position adjustment member is moved vertically and horizontally along the L-shaped hole by the operator, whereby the position adjustment member can be easily moved to the separate position or the mesh position.

In this case, the position adjustment member is preferably movably mounted on the housing by coupling the body and the operating portion with each other through the L-shaped hole. According to this structure, the position adjustment member can be easily mounted on the housing.

In the aforementioned image generating apparatus according to the first aspect, the roller preferably includes a paper feed roller for feeding a paper, and the roller gear preferably includes a paper feed roller gear fixedly mounted on the paper feed roller. According to this structure, the paper feed roller can be easily cleaned.

In the aforementioned structure in which the roller includes the paper feed roller, the position adjustment member preferably includes a first support portion supporting the paper feed roller gear in a state where the paper feed roller gear meshes with the drive gear. According to this structure, the first support portion can support the paper feed roller gear in a state where the paper feed roller gear meshes with the drive gear, whereby the paper feed roller gear can be inhibited from jolting in paper carriage.

In this case, the image generating apparatus preferably further comprises a paper discharge roller, and a paper discharge roller gear meshing with the paper feed roller gear and fixedly mounted on the paper discharge roller, wherein the paper discharge roller gear is so formed as to move following movement of the paper feed roller gear. According to this structure, the paper discharge roller can be cleaned simultaneously in cleaning the paper feed roller.

In the aforementioned structure comprising the paper discharge roller, the position adjustment member preferably includes a second support portion supporting the paper discharge roller gear in a state where the paper feed roller gear meshes with the drive gear. According to this structure, the second support portion can support the paper discharge roller gear in a state where the paper feed roller gear meshing with the paper discharge roller gear meshes with the drive gear, whereby the paper discharge roller gear can be inhibited from jolting in paper discharge.

An image generating apparatus according to a second aspect of the present invention comprises a rotatable roller for carrying a paper, provided movably in an axial direction, a roller gear fixedly mounted on the roller, a drive gear meshing with the roller gear and driven by a driving source, a position adjustment member regulating an axial position of the roller gear so as to hold the roller gear from axial both sides, while capable of moving the roller gear to a separate position for separating the roller gear and the drive gear from each other in a state of applying no pressing force to the roller gear in cleaning the roller and to a mesh position for meshing the roller gear and the drive gear with each other in carrying the paper, a housing provided with an L-shaped hole, and a spring member for inhibiting the position adjustment member from moving from the separate position or the mesh position, wherein the roller mounted with the roller gear is provided movably in the axial direction, the position adjustment member regulates a position of the roller gear so as to hold the roller gear from axial both sides, the position adjustment member includes a body set inside the housing and allowing movement of the roller gear and an operating portion set outside the housing and to be operated by an operator, the position adjustment member is movable vertically and horizontally along the L-shaped hole, and first and second ends of the L-shaped hole correspond to the separate position and the mesh position respectively.

In the image generating apparatus according to the second aspect, as hereinabove described, the position adjustment member regulating the axial position of the roller gear so as to hold the roller gear from the axial both sides while capable of moving the roller gear to the separate position for separating the roller gear and the drive gear from each other in cleaning the roller and to the mesh position for meshing the roller gear and the drive gear with each other in carrying the paper is provided, whereby the movement of the position adjustment member enables switching between a free rotation state allowing free rotation in cleaning the roller and a transmission state to transmit the driving force of the drive gear in carrying the paper. The roller gear and the drive gear are separated from each other in a state of applying no pressing force to the roller gear, thereby allowing smooth free rotation of the roller in cleaning the roller. Additionally, the position adjustment member regulates the axial position of the roller gear so as to hold the roller gear from the axial both sides, whereby a member for regulating the axial movement of the roller and the roller gear in carrying the paper, such as an E-shaped ring or a drop preventing member, may not be separately provided. The roller gear can be moved in both axial directions by moving this position adjustment member, whereby a spring member for urging the roller gear or the like may not be provided. The roller gear can be moved to the separate position or the mesh position due to the movement of the position adjustment member, whereby a slide gear for transmitting or blocking the driving force of the drive motor may not be separately provided. Thus, the number of components can be inhibited from increase. Additionally, a spring member for inhibiting the position adjustment member from moving from the separate position or the mesh position is provided, whereby the state of separating the roller gear and the drive gear from each other or the state of meshing the roller gear and the drive gear with each other can be stably held. Further, the position adjustment member is provided with a body set inside the housing and allowing the movement of the roller gear and an operating portion set outside the housing and to be operated by an operator, whereby the body can be moved due to the operation of the operating portion from the outside of the housing by the operator. Thus, the roller gear can be easily moved. Furthermore, the position adjustment member is formed to be movable vertically and horizontally along the L-shaped hole, and the first and second ends of the L-shaped hole preferably correspond to the separate position and the mesh position respectively, whereby the position adjustment member is moved vertically and horizontally along the L-shaped hole by the operator, whereby the position adjustment member can be easily moved to the separate position or the mesh position.

In the aforementioned image generating apparatus according to the second aspect, the operating portion includes an operating plate to be gripped by the operator. According to this structure, the roller gear can be easily moved due to the operation of the operating plate from the outside of the housing by the operator.

In the aforementioned image generating apparatus according to the second aspect, the position adjustment member is movably mounted on the housing by coupling the body and the operating portion with each other through the L-shaped hole. According to this structure, the position adjustment member can be easily mounted on the housing.

In the aforementioned image generating apparatus according to the second aspect, the roller preferably includes a paper feed roller for feeding a paper, and the roller gear preferably includes a paper feed roller gear fixedly mounted on the paper feed roller. According to this structure, the paper feed roller can be easily cleaned.

In the aforementioned structure in which the roller includes the paper feed roller, the position adjustment member preferably includes a first support portion supporting the paper feed roller gear in a state where the paper feed roller gear meshes with the drive gear. According to this structure, the first support portion can support the paper feed roller gear in a state where the paper feed roller gear meshes with the drive gear, whereby the paper feed roller gear can be inhibited from jolting in paper carriage.

In this case, the image generating apparatus preferably further comprises a paper discharge roller, and a paper discharge roller gear meshing with the paper feed roller gear and fixedly mounted on the paper discharge roller, wherein the paper discharge roller gear is so formed as to move following movement of the paper feed roller gear. According to this structure, the paper discharge roller can be cleaned simultaneously in cleaning the paper feed roller.

In the aforementioned structure comprising the paper discharge roller, the position adjustment member preferably includes a second support portion supporting the paper discharge roller gear in a state where the paper feed roller gear meshes with the drive gear. According to this structure, the second support portion can support the paper discharge roller gear in a state where the paper feed roller gear meshing with the paper discharge roller gear meshes with the drive gear, whereby the paper discharge roller gear can be inhibited from jolting in paper discharge.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An embodiment of the present invention will be hereinafter described with reference to the drawings.

A structure of a dye sublimation printer according to the embodiment will be now described with reference to FIGS. 1 to 10. This embodiment of the present invention is applied to the dye sublimation printer, which is an exemplary image generating apparatus.

Figure 1:
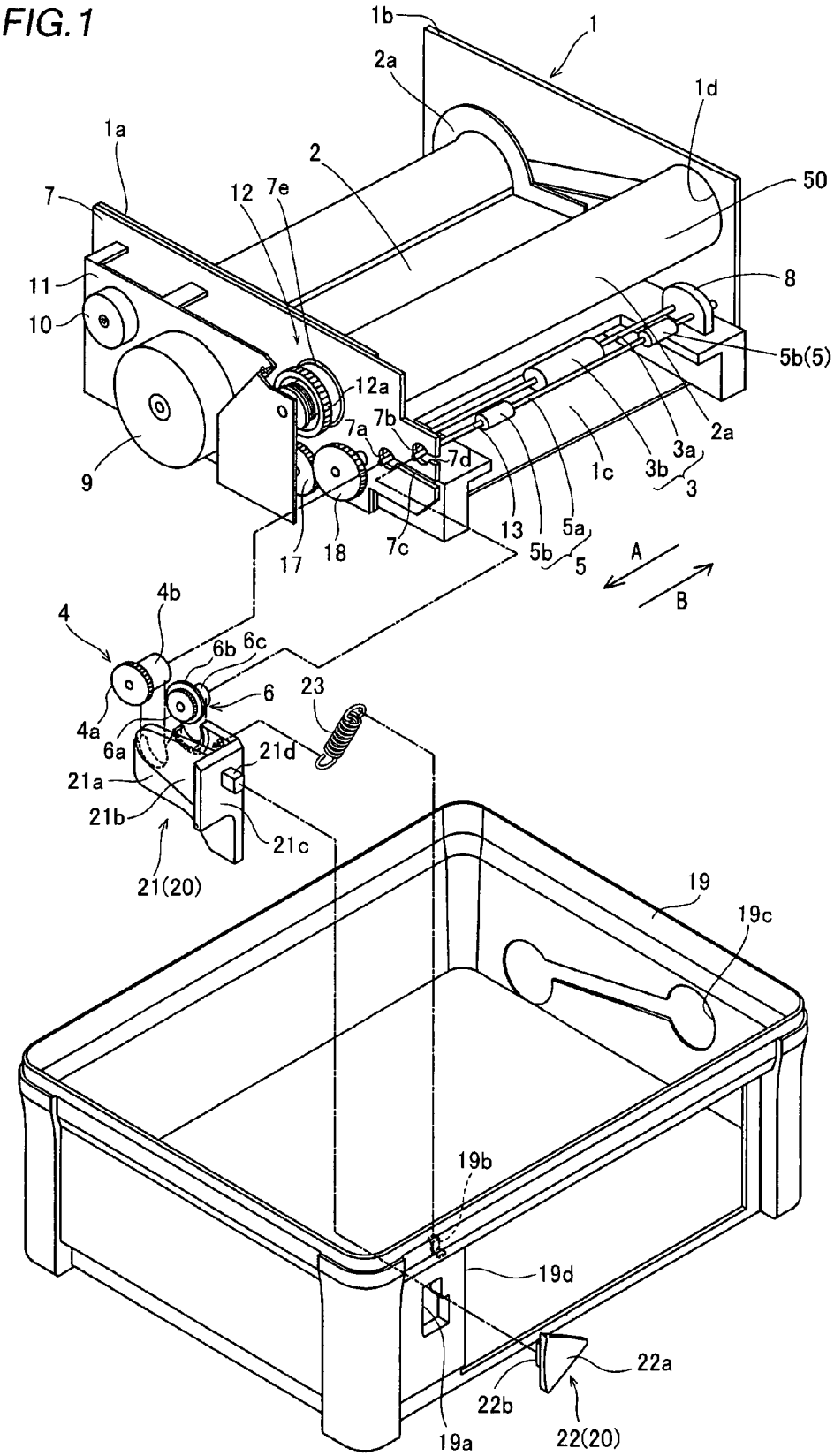
FIG. 1 is an exploded perspective view showing an overall structure of a dye sublimation printer according to an embodiment of the present invention.
Figure 2:
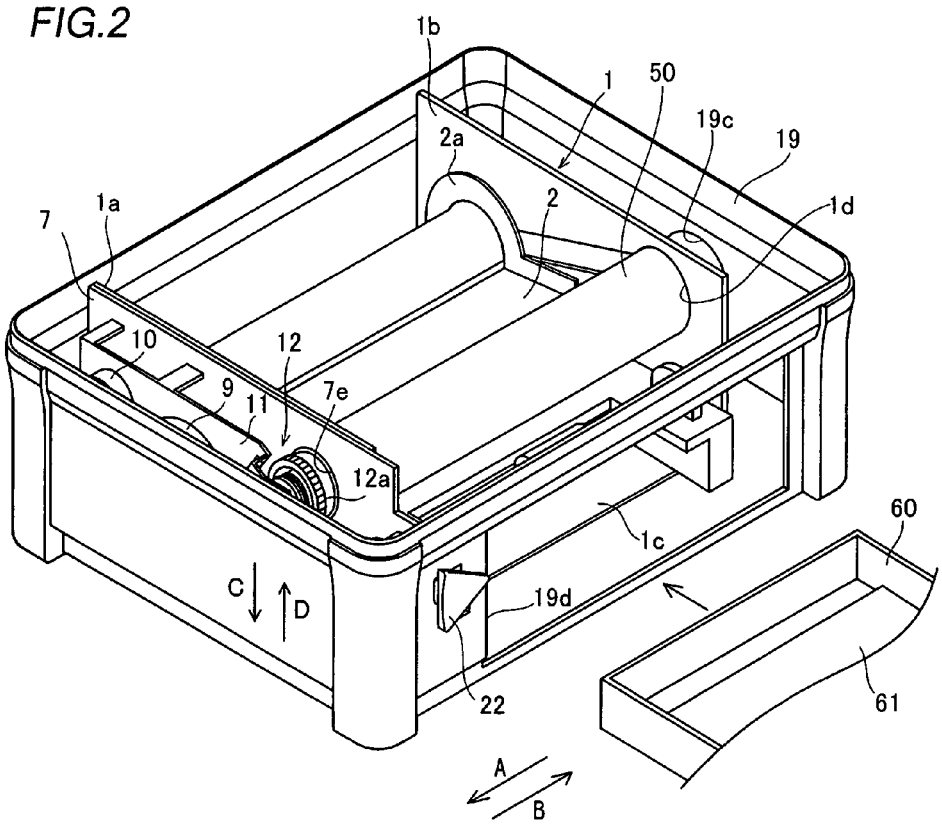
FIG. 2 is a perspective view showing the overall structure of the dye sublimation printer according to the embodiment of the present invention.

As shown in FIG. 1, the dye sublimation printer according to the embodiment comprises a chassis 1 made of metal, a print head 2 for performing printing, a paper feed roller 3, a paper feed roller gear 4 mounted on a first end of the paper feed roller 3, a paper discharge roller 5, a paper discharge roller gear 6 mounted on a first end of the paper discharge roller 5, a side plate 7 supporting the paper feed roller gear 4 and the paper discharge roller gear 6, a support portion 8 supporting second ends of the paper feed roller 3 and the paper discharge roller 5, a stepping motor 9 for driving the paper feed roller gear 4 and the paper discharge roller gear 6, a stepping motor 10 as a driving source for rotating the print head 2, a motor bracket 11 mounted with the stepping motors 9 and 10, a take-up reel 12 for taking up an ink sheet (not shown), a feed roller gear 13 mounted on a feed roller 13*a* for carrying a paper inside the dye sublimation printer (see FIG. 3), a swingable swing gear 14 (see FIG. 3), a plurality of intermediate gears 15 to 18 (see FIG. 3), and a housing 19 storing the aforementioned chassis 1 to the intermediate gear 18. In the dye sublimation printer according to the embodiment, an ink sheet cartridge 50 storing the ink sheet (not shown) and a paper cassette 60 storing a paper 61 (see FIG. 2) are detachably mounted, as shown in FIGS. 1 and 2. The paper feed roller 3, the paper feed roller gear 4, the stepping motor 9 and the intermediate gear 18 are examples of the "roller", the "roller gear", the "driving source" and the "drive gear" in the present invention, respectively.

As shown in FIGS. 1 and 2, the chassis 1 has first and second side surfaces 1*a* and 1*b* and a bottom surface 1*c*. As shown in FIG. 1, the aforementioned side plate 7 and the motor bracket 11 are mounted on the first side surface 1*a* of the chassis 1. A receiving hole 1*d* for receiving the ink sheet cartridge 50 is provided on the second side surface 1*b* of the chassis 1. An opening (not shown) in which the take-up reel 12 is arranged is provided on the first side surface 1*a* of the chassis 1.

As shown in FIGS. 1 and 2, the print head 2 performing printing has arm portions 2*a*. The print head 2 is rotatably mounted on inner sides of the first and second side surfaces and lb of the chassis 1 about support shafts (not shown) engaging with ends (not shown) of the arm portions 2*a*.

The paper feed roller 3 is provided for carrying the paper 61 to a printing position for performing printing with the print head 2. More specifically, the paper feed roller 3 pushed up with a push-up plate (not shown) to rotate presses the paper 61 placed on the aforementioned paper cassette 60 so that the paper 61 is fed inside the dye sublimation printer. The paper feed roller 3 has a shaft portion 3*a* made of metal and a roller portion 3*b* made of rubber fitted around the shaft portion 3*a*, as shown in FIG. 1. The paper feed roller gear 4 is fixedly mounted on a first end (end closer to the first side surface 1*a* of the chassis 1) of the shaft portion 3*a* of the paper feed roller 3.

Figure 3:
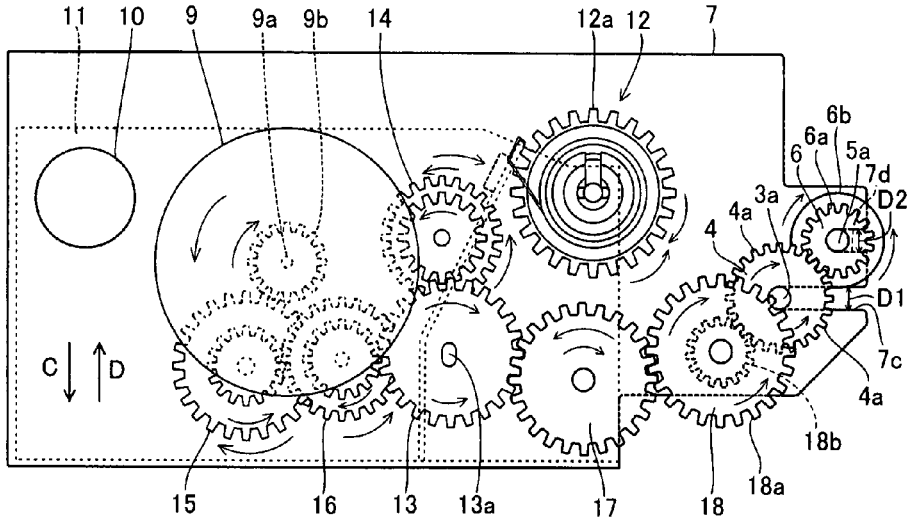
FIG. 3 is a side elevational view for illustrating arrangement of drive motors and gears of the dye sublimation printer according to the embodiment of the present invention.
Figure 6:
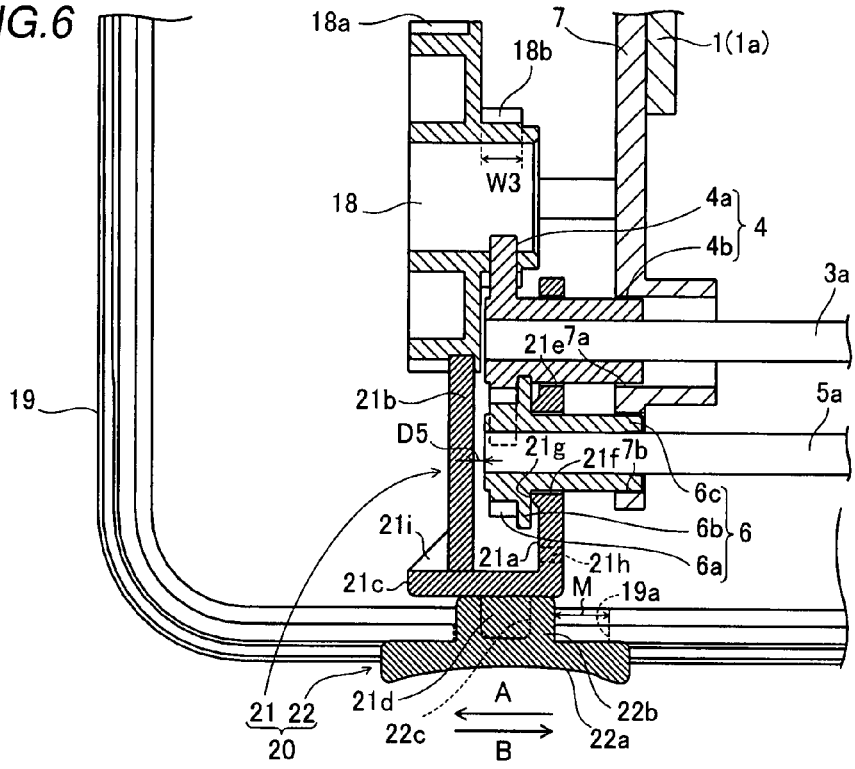
FIG. 6 is a top view showing the meshing state between the paper feed roller gear and the intermediate gear of the dye sublimation printer according to the embodiment of the present invention.

The paper feed roller gear 4 integrally rotates with the shaft portion 3*a* of the paper feed roller 3. The paper feed roller gear 4 meshes with an after-mentioned small-diametral gear 18*b* of the intermediate gear 18 as shown in FIG. 3 and rotates following rotation of the intermediate gear 18. As shown in FIGS. 3 and 6, a large-diametral gear 18*a* of the intermediate gear 18 fixedly mounted on the side plate 7 in an axial direction (along arrow A or B) regulates movement of the paper feed roller gear 4 along arrow A. The paper feed roller gear 4 includes a gear portion 4*a* meshing with the small-diametral gear 18*b* of the intermediate gear 18 and a bearing receiving portion 4*b* receiving an after-mentioned bearing 7*a* (see FIG. 6) of the side plate 7.

The paper discharge roller 5 is provided for carrying the paper 61 in a discharge direction (printing direction) in printing by the print head 2 and discharging the paper 61 printed by the print head 2. The paper discharge roller 5 has a shaft portion 5*a* made of metal and two roller portions 5*b* made of rubber fitted around the shaft portion 5*a* as shown in FIG. 1. The paper discharge roller gear 6 is fixedly mounted on a first end (end closer to the first side surface 1*a* of the chassis 1) of the shaft portion 5*a* of the paper discharge roller 5.

The paper discharge roller gear 6 integrally rotates with the shaft portion 5*a* of the paper discharge roller 5. As shown in FIG. 3, the paper discharge roller gear 6 meshes with the paper feed roller gear 4, and rotates following rotation of the paper feed roller gear 4. The paper discharge roller gear 6 includes a gear portion 6*a* meshing with the gear portion 4*a* of the paper feed roller gear 4, a position regulating flange 6*b* provided adjacent to the gear portion 6*a* along arrow B, and a bearing receiving portion 6*c* receiving an after-mentioned bearing 7*b* receiving of the side plate 7, as shown in FIG. 1. The position regulating flange 6*b* has an outer diameter large than the outermost diameter of the gear portion 6*a*, and a side surface of the position regulating flange 6*b* along arrow A and a side surface of the gear portion 4*a* of the paper feed roller gear 4 along arrow B come into contact with each other, thereby regulating movement of the paper discharge roller gear 6 along arrow A.

The side plate 7 made of resin includes the bearing 7*a* mounted on the first side surface 1*a* of the chassis 1 and receiving the bearing receiving portion 4*b* of the paper feed roller gear 4, the bearing 7*b* receiving the bearing receiving portion 6*c* of the paper discharge roller gear 6, notches 7*c* and 7*d* (see FIGS. 1 and 3) for mounting the paper feed roller 3 and the paper discharge roller 5 on the bearing 7*a* and the bearing 7*b* respectively, and an opening portion 7*e* (see FIG. 1) on which the take-up reel 12 is arranged, as shown in FIGS. 1 and 6.

According to this embodiment, the bearings 7*a* and 7*b* are so formed as to have penetrated circular inner circumferential surfaces. As shown in FIG. 6, the bearing 7*a* is so provide as to protrude from the side plate 7 along arrow B. The paper feed roller gear 4 and the paper discharge roller gear 6 are slidable in an axial direction (along arrows A and B) with respect to the side plate 7. As shown in FIG. 3, intervals D1 and D2 of the notches 7*c* and 7*d* are so formed as to be larger than the diameters of the shaft portion 3*a* of the paper feed roller 3 and the shaft portion 5*a* of the paper discharge roller 5 and smaller than the diameters of the bearing receiving portion 4*b* of the paper feed roller gear 4 and the bearing receiving portion 6*c* of the paper discharge roller gear 6.

Figure 4:
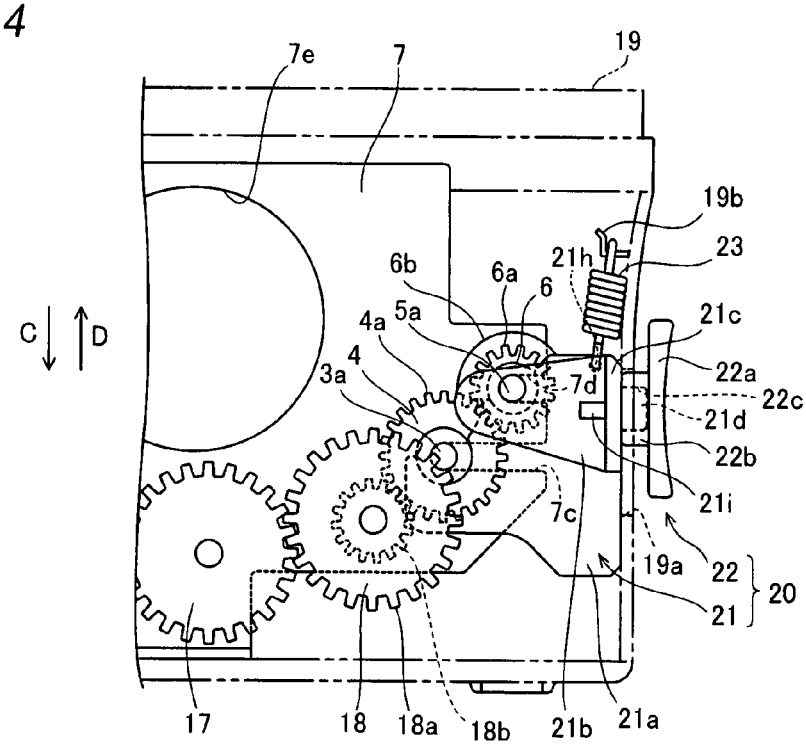
FIG. 4 is a side elevational view showing a meshing state between a paper feed roller gear and an intermediate gear of the dye sublimation printer according to the embodiment of the present invention.
Figure 5:
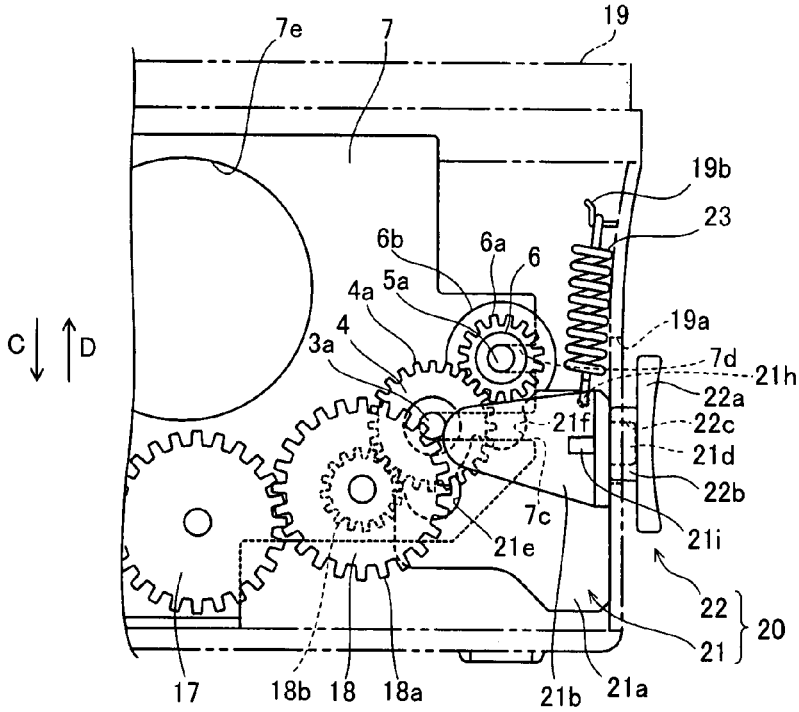
FIG. 5 is a side elevational view showing a separate state between the paper feed roller gear and the intermediate gear of the dye sublimation printer according to the embodiment of the present invention.
Figure 7:
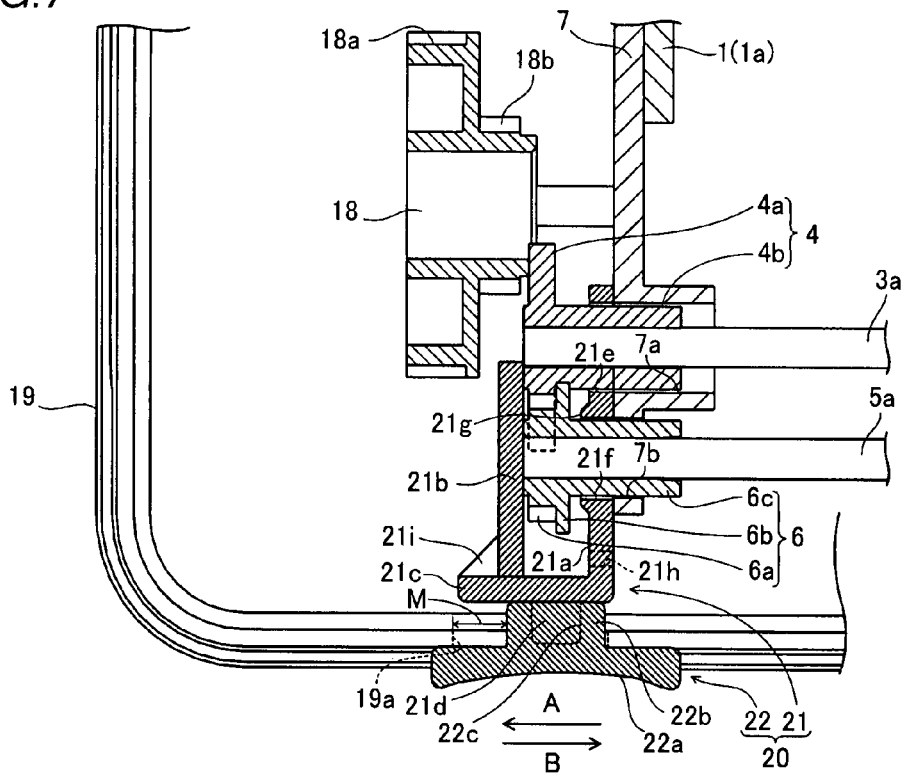
FIG. 7 is a top view showing the separate state between the paper feed roller gear and the intermediate gear of the dye sublimation printer according to the embodiment of the present invention.
Figure 8:
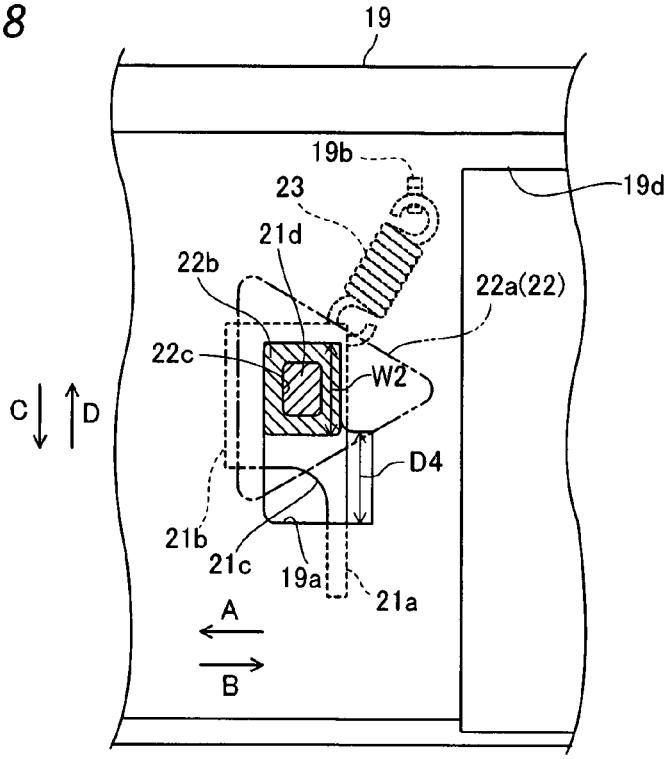
FIG. 8 is a front elevational view showing the meshing state between the paper feed roller gear and the intermediate gear of the dye sublimation printer according to the embodiment of the present invention.
Figure 9:
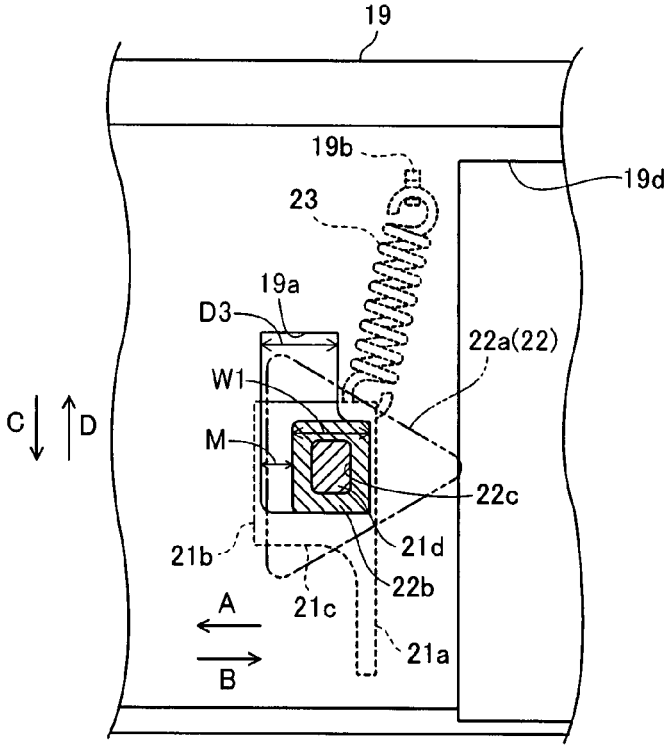
FIG. 9 is a front elevational view showing the separate state between the paper feed roller gear and the intermediate gear of the dye sublimation printer according to the embodiment of the present invention.

The dye sublimation printer according to the embodiment further comprises a position adjustment member 20 provided for switching a meshing state in which the paper feed roller gear 4 and the intermediate gear 18 mesh with each other and a separate state in which the paper feed roller gear 4 and the intermediate gear 18 are separated from each other. This position adjustment member 20 can press and move the paper feed roller gear 4, and does not apply pressing force to the paper feed roller gear 4 after movement (meshing or separate state) as shown in FIG. 1 and FIGS. 4 to 7. The position adjustment member 20 is movable as described later, and is constituted by the position adjustment portion 21 ant the operating portion 22. The dye sublimation printer according to the embodiment is provided with a helical tension spring 23 for inhibiting the position adjustment member 20 from moving from the after-mentioned mesh position or separate position. FIGS. 4, 6 and 8 show the meshing state, while FIGS. 5, 7 and 9 show the separate state. The helical tension spring 23 and the position adjustment portion 21 are examples of the "spring member" and the "body" in the present invention respectively.

Figure 10:
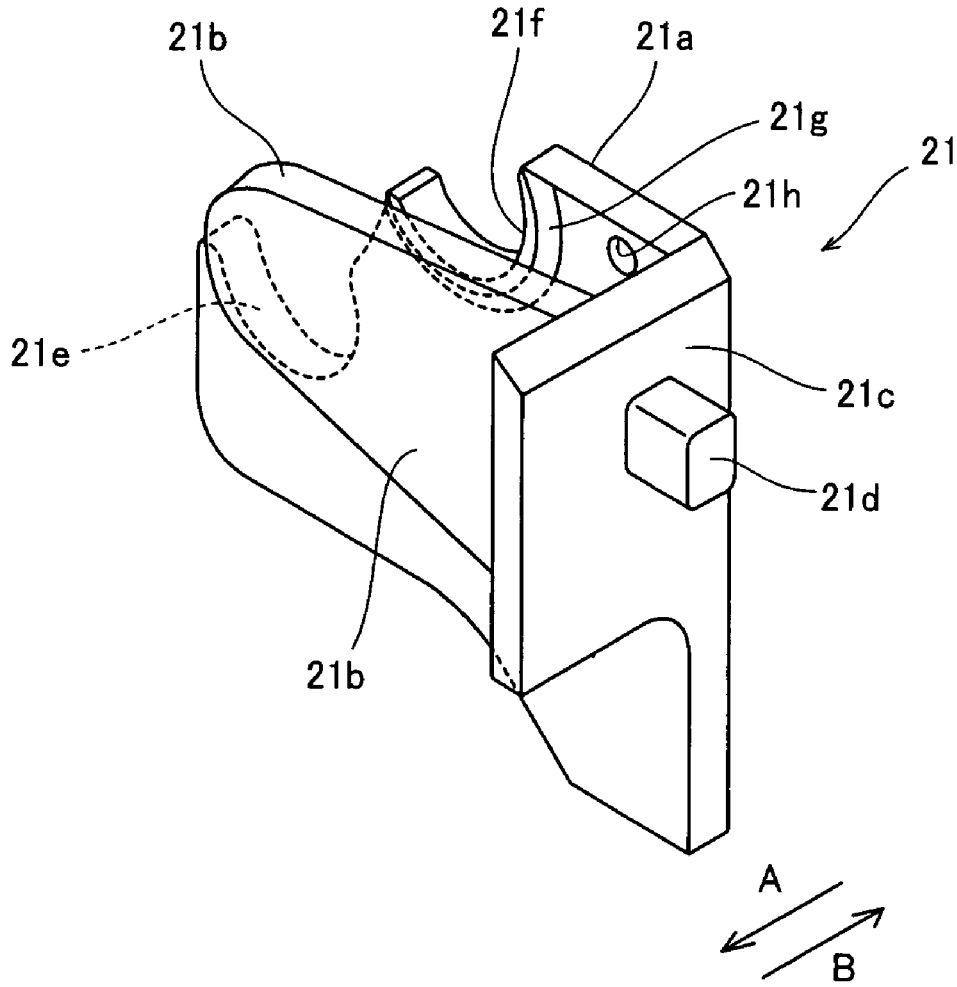
FIG. 10 is an enlarged perspective view of a position adjustment portion of a position adjustment member shown in FIG. 1.

The position adjustment portion 21 is arranged inside housing 19, while the operating portion 22 is arranged outside the housing 19. The position adjustment portion 21 regulates movement in the axial direction (along arrows A and B) so as to hold the gear portion 4*a* of the paper feed roller gear 4 and the gear portion 6*a* of the paper discharge roller gear 6. As shown in FIG. 10, this position adjustment portion 21 includes a position regulating section 21*a* arranged along arrow B with respect to the gear portion 4*a* of the paper feed roller gear 4 and the gear portion 6*a* of the paper discharge roller gear 6, a pressing section 21*b* arranged along arrow A with respect to the gear portion 4*a* of the paper feed roller gear 4 and the gear portion 6*a* of the paper discharge roller gear 6, a coupling portion 21*c* coupling the position regulating section 21*a* and the pressing section 21*b*, and a convex rectangular engaging portion 21*d* so provided as to protrude from the coupling portion 21*c* and engaging with the operating portion 22.

This position regulating section 21*a* includes support portions 21*e* and 21*f* supporting the bearing receiving portion 4*b* of the paper feed roller gear 4 and the bearing receiving portion 6*c* of the paper discharge roller gear 6 from the lower side respectively, a rib 21*g* provided to protrude from an edge of the support portion 21*f* along arrow A, and a mounting hole 21*h* mounting with a first end of the helical tension spring 23. The support portions 21*e* and 21*f* have arcuate shapes corresponding to surfaces of the bearing receiving portions 4*b* and 6*c* respectively, and have functions of supporting the bearing receiving portions 4*b* and 6*c* in a state where the paper feed roller gear 4 meshes with the intermediate gear 18 (meshing state). Thus, the paper feed roller gear 4 and the paper discharge roller gear 6 are inhibited from jolting in a paper feeding operation. The rib 21*g* regulates movement of the paper discharge roller gear 6 along arrow B by coming into contact with a side surface of the position regulating flange 6*b* of the paper discharge roller gear 6 along arrow B. The position regulating flange 6*b* of the paper discharge roller gear 6 regulates movement of the paper feed roller gear 4 along arrow B, whereby the rib 21*g* regulates the movement of the paper feed roller gear 4 and the paper discharge roller gear 6 along arrow B. The support portions 21*e* and 21*f* are examples of the "first support portion" and the "second support portion" in the present invention respectively.

The pressing section 21*b* has a function of moving the paper feed roller gear 4 and the paper discharge roller gear 6 along arrow B by pressing the side surface of the gear portion 4*a* of the paper feed roller gear 4 along arrow A and the side surface of the gear portion 6*a* of the paper discharge roller gear 6 along arrow A by movement of the pressing section 21*b* along arrow B. A reinforcing rib 21*i* (see FIGS. 6 and 7) of the pressing section 21*b* is provided on a bottom of the pressing section 21*b* along arrow A.

The operating portion 22 has a triangular operating plate 22*a* and an engaging portion 22*b* so provided as to protrude from the operating plate 22*a*. The engaging portion 22*b* of the operating portion 22 is provided with a rectangular recess portion 22*c* receiving the engaging portion 21*d* of the position adjustment portion 21. The engaging portion 22*b* of the operating portion 22 is engaged with the engaging portion 21*d* of the position adjustment portion 21 through an L-shaped hole 19*a* of the housing 19. Thus, the operating plate 22*a* is operated along the L-shaped hole 19*a* by a user, whereby the position adjustment portion 21 engaging with the operating portion 22 is moved. A horizontal width W1 of the engaging portion 22*b* of the operating portion 22 is substantially equal to or slightly smaller than a horizontal interval D3 of the L-shaped hole 19*a* as shown in FIG. 9, while a vertical width W2 of the L-shaped hole is substantially equal to or slightly larger than a vertical interval D4 of the engaging portion 22*b* of the operating portion 22 as shown in FIG. 8. Thus, the position adjustment member 20 is movable with respect to the L-shaped hole 19*a* and jolting is reduced. As shown in FIG. 6, horizontal slide stroke M of the position adjustment member 20 is larger than a sum of an interval D5 between the pressing section 21*b* of the position adjustment portion 21 and the gear portion 4*a* of the paper feed roller gear 4 and the gear portion 6*a* of the paper discharge roller gear 6 and a width W3 of the small-diametral gear 18*b* of the intermediate gear 18.

As shown in FIG. 8, in the case where the engaging portion 22*b* of the operating portion 22 is located on an upper end of the L-shaped hole 19*a*, the small-diametral gear 18*b* of the intermediate gear 18 and the gear portion 4*a* of the paper feed roller gear 4 mesh with each other, while the support portion 21*e* and the support portion 21*f* of the position regulating section 21*a* support the bearing receiving portion 4*b* of the paper feed roller gear 4 and the bearing receiving portion 6*c* of the paper discharge roller gear 6. At this time, the position adjustment member 20 is located at the mesh position. As shown in FIG. 9, in the case where the engaging portion 22*b* of the operating portion 22 is located on an end of the L-shaped hole 19*a* along arrow B, the small-diametral gear 18*b* of the intermediate gear 18 and the gear portion 4*a* of the paper feed roller gear 4 are separated from each other while the support portion 2l*e* and the support portion 21*f* of the position regulating section 21*a* are separated from the bearing receiving portion 4*b* of the paper feed roller gear 4 and the bearing receiving portion 6*c* of the paper discharge roller gear 6 toward the lower side. At this time, the position adjustment member 20 is located at the separate position.

As shown in FIGS. 4 and 5, the helical tension spring 23 has a first end mounted on the mounting hole 21*h* of the position regulating section 21*a* of the position adjustment portion 21 and a second end mounted on a spring clip portion 19*b* integrally provided on an inner surface of the housing 19. As shown in FIGS. 8 and 9, the spring clip portion 19*b* of the housing 19 is provided on the upper side along arrow B with respect to the L-shaped hole 19*a*. Thus, the helical tension spring 23 urges the position adjustment member 20 upward along arrow B as viewed from the L-shaped hole 19*a*.

The support portion 8 is provided on the second side surface 1*b* of the chassis 1, and rotatably supports the shaft portion 3*a* of the paper feed roller 3 and the shaft portion 5*a* of the paper discharge roller 5 in the axial direction (along arrow A or B). Thus, the paper feed roller 3 and the paper feed roller gear 4, and the paper discharge roller 5 and the paper discharge roller gear 6 are slidable in the axial direction (along arrow A or B).

As shown in FIG. 3, a shaft portion 9*a* of the stepping motor 9 mounted on the motor bracket 11 is mounted with a motor gear 9*b*. Driving force of the stepping motor 9 is transmitted to the feed roller gear 13 through the motor gear 9*b* and the intermediate gears 15 and 16. The paper feed roller gear 4 and the paper discharge roller gear 6 are so formed as to be rotated through the intermediate gears 17 and 18 by rotation of the feed roller gear 13. The swing gear 14 located above the feed roller gear 13 is swung by the rotation of the feed roller gear 13 and meshes with the gear portion 12*a* of the take-up reel 12, thereby rotating the gear portion 12*a* of the take-up reel 12. Thus, the stepping motor 9 has a function as a driving source for driving the gear portion 12*a* of the take-up reel 12, the feed roller gear 13, the paper feed roller gear 4 and the paper discharge roller gear 6. The stepping motor 10 has a function as a driving source rotating a pressing member (not shown) for pressing the print head 2 against the platen roller (not shown) through the gear (not shown).

The take-up reel 12 is provided for taking up the ink sheet (not shown) stored in an ink sheet cartridge 60 by rotation upon receipt of the driving force of the stepping motor 9 to rotate. The take-up reel 12 has the gear portion 12*a* meshing with the swing gear 14.

The housing 19 is provided with a hole 19*c* for receiving the ink sheet cartridge 50 and a slot 19*d* for receiving the paper cassette 60.

With reference to FIGS. 4 to 9, a description will be now made of switching operations between the meshing state (normal state) and the separate state (state of cleaning the roller) of the intermediate gear 18 and the paper feed roller gear 4 in the dye sublimation printer according to the embodiment.

As shown in FIGS. 4 and 6, the small-diametral gear 18*b* of the intermediate gear 18 and the gear portion 4*a* of the paper feed roller gear 4 mesh with each other in the meshing state. The intermediate gear 18 is coupled to the stepping motor 9 through the plurality of intermediate gears 15 to 17, the feed roller gear 13 and the motor gear 9*b*. Thus, the rotation of the paper feed roller gear 4 and the paper discharge roller gear 6 is regulated, whereby the paper feed roller 3 and the paper discharge roller 5 can not freely rotate. In the meshing state, the engaging portion 22*b* of the operating portion 22 is located on the upper end (mesh position) of the L-shaped hole 19*a* as shown in FIG. 8.

In the case of switching from this meshing state (normal state) to the separate state (state of cleaning the roller), the operating portion 22 is first lowered vertically downward (along arrow C in FIG. 8) by the user until a lower surface of the engaging portion 22*b* of the operating portion 22 and a lower edge of the L-shaped hole 19*a* come into contact with each other. At this time, the position adjustment portion 21 is also simultaneously lowered vertically downward, whereby the support portion 21*e* and the support portion 21*f* of the position adjustment portion 21 are separated from the bearing receiving portion 4*b* of the paper feed roller gear 4 and the bearing receiving portion 6*c* of the paper discharge roller gear 6 respectively.

Thereafter the operating portion 22 is slid along arrow B by the user. Thus, when the position adjustment portion 21 is also slid along arrow B, and the pressing section 21*b* of the position adjustment portion 21 comes into contact with the side surfaces of the paper feed roller gear 4 and the paper discharge roller gear 6 along arrow A. Then, when the operating portion 22 is further slid along arrow B, the pressing section 21*b* of the position adjustment portion 21 moves the paper feed roller gear 4 and the paper feed roller 3 and the paper discharge roller gear 6 and the paper discharge roller 5 along arrow B.

When a side surface of the engaging portion 22*b* of the operating portion 22 along arrow B and an edge of the L-shaped hole 19*a* along arrow B are slid until they come into contact with each other, the paper feed roller gear 4 moves by a distance larger than a width W3 (see FIG. 6) of the small-diametral gear 18*b* of the intermediate gear 18. Thus, as shown in FIG. 7, the mesh between the gear portion 4*a* of the paper feed roller gear 4 and the small-diametral gear 18*b* is released. Thus, the rotation of the paper feed roller gear 4 and the paper discharge roller gear 6 is not regulated, whereby the paper feed roller 3 and the paper discharge roller 5 can freely rotate. Even the user releases his hand in this state, the position adjustment member 20 is urged upward along arrow B by the helical tension spring 23 as shown in FIG. 9, thereby inhibiting a position of the position adjustment member 20 from deviating from the separate position. Thus, the user can clean the paper feed roller 3 and the paper discharge roller 5 or the like.

In the case of switching from this separate state to the meshing state, the operating portion 22 is first slid along arrow A from the separate position shown in FIG. 9 by the user. Thus, the rib 21*g* of the position adjustment portion 21 coming into contact with the side surface of the gear portion 6*a* of the paper discharge roller gear 6 along arrow B presses the paper discharge roller gear 6 along arrow A. Then, the paper discharge roller gear 6 moves along arrow A. The position regulating flange 6*b* of the paper discharge roller gear 6 presses the surface of the gear portion 4*a* of the paper feed roller gear 4 along arrow B, whereby the paper feed roller gear 4 is also moved along arrow A.

When the engaging portion 22*b* of the operating portion 22 is slid until the same comes into contact with the edge of the L-shaped hole 19*a* along arrow A, the paper feed roller gear 4 meshes with the small-diametral gear 18*b* of the intermediate gear 18. Thereafter the operating portion 22 is slid upward (along arrow D in FIG. 9) to bring the engaging portion 22*b* into contact with an upper edge of the L-shaped hole 19*a*. Thus, as shown in FIG. 4, the position adjustment member 20 is located at the mesh position, and the support portion 21*e* and the support portion 21*f* of the position regulating section 21*a* support the bearing receiving portion 4*b* of the paper feed roller gear 4 and the bearing receiving portion 6*c* of the paper discharge roller gear 6 respectively. Even the user releases his hand in this state, the position adjustment member 20 is urged upward along arrow B by the helical tension spring 23 as shown in FIG. 8, thereby inhibiting the position of the position adjustment member 20 from deviating from the mesh position. Thus, the mesh between the intermediate gear 18 and the paper feed roller gear 4 is held, whereby a printing operation can be performed.

According to this embodiment, as hereinabove described, the position adjustment member 20 regulating the axial position of the paper feed roller gear 4 so as to hold the paper feed roller gear 4 from axial both sides while capable of moving the paper feed roller gear 4 to the separate position for separating the paper feed roller gear 4 and the intermediate gear 18 from each other in cleaning of the paper feed roller 3 and to the mesh position for meshing the paper feed roller gear 4 and the intermediate gear 18 with each other in carrying the paper 61 is provided, whereby the movement of the position adjustment member 20 enables switching between a free rotation state allowing free rotation in cleaning the paper feed roller 3 and a transmission state to transmit the driving force of the intermediate gear 18 in carrying the paper 61. The paper feed roller gear 4 and the intermediate gear 18 are separated from each other in cleaning the paper feed roller 3 in a state of applying no pressing force to the paper feed roller gear 4, thereby allowing smooth free rotation of the paper feed roller 3.

According to this embodiment, as hereinabove described, the position adjustment member 20 regulates the axial position of the paper feed roller gear 4 so as to hold the paper feed roller gear 4 from the axial both sides, whereby a member for regulating the axial movement of the paper feed roller 3 and the paper feed roller gear 4 in carrying the paper 61, such as an E-shaped ring or a drop preventing member, may not be separately provided. The paper feed roller gear 4 can be moved in both axial directions by moving this position adjustment member 20, whereby a spring member for urging the paper feed roller gear 4 or the like may not be provided. The paper feed roller gear 4 can be moved to the separate position or the mesh position due to the movement of the position adjustment member 20, whereby a slide gear for transmitting or blocking the driving force of the drive motor may not be separately provided. Thus, the number of components can be inhibited from increase.

According to this embodiment, as hereinabove described, the helical tension spring 23 for inhibiting the position adjustment member 20 from moving from the separate position or the mesh position is provided, whereby the state of separating the paper feed roller gear 4 and the intermediate gear 18 from each other (separate state) or the state of meshing the paper feed roller gear 4 and the intermediate gear 18 with each other (meshing state) can be stably held.

According to this embodiment, as hereinabove described, the position adjustment member 20 is constituted by the position adjustment portion 21 set inside the housing 19 and enabling the movement of the paper feed roller gear 4 and the operating portion 22 set outside the housing 19 and to be operated by an operator, whereby the position adjustment portion 21 can be moved due to the operation of the operating portion 22 from the outside of the housing 19 by the operator. Thus, the paper feed roller gear 4 can be easily moved.

According to this embodiment, as hereinabove described, the position adjustment member 20 is movably mounted on the housing 19 by coupling the position adjustment portion 21 and the operating portion 22 with each other through the L-shaped hole 19*a*, whereby the position adjustment member 20 can be easily mounted on the housing 19.

According to this embodiment, as hereinabove described, the position adjustment member 20 is provided with the support portion 21*e* supporting the paper feed roller gear 4 in the state in which the paper feed roller gear 4 meshes with the intermediate gear 18, whereby the support portion 21*e* can support the paper feed roller gear 4 in the state in which the paper feed roller gear 4 meshes with the intermediate gear 18. Thus, the paper feed roller gear 4 can be inhibited from jolting in paper carriage.

According to this embodiment, as hereinabove described, the paper discharge roller gear 6 is so formed as to move following the movement of the paper feed roller gear 4, whereby the paper discharge roller 5 can be cleaned simultaneously in cleaning the paper feed roller 3.

According to this embodiment, as hereinabove described, the position adjustment member 20 is provided with the support portion 21*f* supporting the paper discharge roller gear 6 in the state in which the paper feed roller gear 4 meshes with the intermediate gear 18, whereby the support portion 21*f* can support the paper discharge roller gear 6 in the state where the paper feed roller gear 4 meshing with the paper discharge roller gear 6 meshes with the intermediate gear 18. Thus, the paper discharge roller gear 6 can be inhibited from jolting in paper discharge.

According to this embodiment, as hereinabove described, the position adjustment member 20 is so formed as to be movable vertically and horizontally (along arrow A or B) along the L-shaped hole 19*a*, and the first end and the second end of the L-shaped hole 19*a* correspond to the separate position and the mesh position respectively, whereby the position adjustment member 20 is moved vertically and horizontally (along arrow A or B) along the L-shaped hole by the user. Thus, the position adjustment member 20 can be easily moved to the separate position or the mesh position.

Although the present invention has been described and illustrated in detail, it is clearly understood that the same is by way of illustration and example only and is not to be taken by way of limitation, the spirit and scope of the present invention being limited only by the terms of the appended claims.

For example, while the aforementioned embodiment is applied to the dye sublimation printer employed as an exemplary image generating apparatus, the present invention is not restricted to this but is also applicable to another image generating apparatus other than the dye sublimation printer so far as the same comprises a roller.

While the aforementioned embodiment is applied to the paper feed roller, the present invention is not restricted to this but is also applicable to another roller other than the feed roller.

While the helical tension spring 23 for inhibiting the position adjustment member 20 from moving from the mesh position and the separate position in the aforementioned embodiment, the present invention is not restricted to this but a stop portion for stopping the position adjustment member 20 at the mesh position and the separate position of the L-shaped hole 19*a* of the housing 19 may be alternatively integrally provided. Thus, effects of the present invention can be obtained without using the helical tension spring. In this case, a rectangular hole may be formed instead of the L-shaped hole.

What is claimed is:

1. An image generating apparatus comprising:

a rotatable roller for carrying a paper, provided movably in an axial direction;

a roller gear fixedly mounted on said roller;

a drive gear meshing with said roller gear and driven by a driving source; and a position adjustment member regulating an axial position of said roller gear so as to hold said roller gear from axial both sides, while capable of moving said roller gear to a separate position for separating said roller gear and said drive gear from each other in a state of applying no pressing force to said roller gear and to a mesh position for meshing said roller gear and said drive gear with each other in carrying said paper, wherein said roller is so formed as to move along the axial direction with said roller gear following movement of said roller gear from a first position of either said separate position or said mesh position to a second position of either said separate position or said mesh position by said position adjustment member.

2. The image generating apparatus according to claim 1, further comprising a spring member for inhibiting said position adjustment member from moving from said separate position or said mesh position.

3. The image generating apparatus according to claim 1, further comprising a housing, wherein said position adjustment member includes a body set inside said housing and allowing movement of said roller gear and an operating portion set outside said housing and to be operated by an operator.

4. The image generating apparatus according to claim 3, wherein said operating portion includes an operating plate to be gripped by the operator.

5. The image generating apparatus according to claim 1, wherein said roller includes a paper feed roller for feeding a paper, and said roller gear includes a paper feed roller gear fixedly mounted on said paper feed roller.

6. The image generating apparatus according to claim 5, wherein said position adjustment member includes a first support portion supporting said paper feed roller gear in a state where said paper feed roller gear meshes with said drive gear.

7. An image generating apparatus comprising:

a rotatable roller for carrying a paper, provided movably in an axial direction;

a roller gear fixedly mounted on said roller;

a drive gear meshing with said roller gear and driven by a driving source; and a position adjustment member regulating an axial position of said roller gear so as to hold said roller gear from axial both sides, while capable of moving said roller gear to a separate position for separating said roller gear and said drive gear from each other in a state of applying no pressing force to said roller gear and to a mesh position for meshing said roller gear and said drive gear with each other in carrying said paper; wherein said position adjustment member includes a body set inside said housing and allowing movement of said roller gear and an operating portion set outside said housing and to be operated by an operator;

said housing is provided with an L-shaped hole;

said position adjustment member is movable vertically and horizontally along said L-shaped hole; and first and second ends of said L-shaped hole correspond to said separate position and said mesh position respectively.

8. The image generating apparatus according to claim 7, wherein said position adjustment member is movably mounted on said housing by coupling said body and said operating portion with each other through said L-shaped hole.

9. An image generating apparatus comprising:

a rotatable roller for carrying a paper, provided movably in an axial direction;

a roller gear fixedly mounted on said roller;

a drive gear meshing with said roller gear and driven by a driving source;

a position adjustment member regulating an axial position of said roller gear so as to hold said roller gear from axial both sides, while capable of moving said roller gear to a separate position for separating said roller gear and said drive gear from each other in a state of applying no pressing force to said roller gear and to a mesh position for meshing said roller gear and said drive gear with each other in carrying said paper;

a paper discharge roller; and a paper discharge roller gear meshing with said paper feed roller gear and fixedly mounted on said paper discharge roller; wherein said position adjustment member includes a first support portion supporting said paper feed roller gear in a state where said paper feed roller gear meshes with said drive gear; and said paper discharge roller gear is so formed as to move following movement of said paper feed roller gear.

10. The image generating apparatus according to claim 9, wherein said position adjustment member includes a second support portion supporting said paper discharge roller gear in a state where said paper feed roller gear meshes with said drive gear.

11. An image generating apparatus comprising:

a rotatable roller for carrying a paper, provided movably in an axial direction;

a roller gear fixedly mounted on said roller;

a drive gear meshing with said roller gear and driven by a driving source;

a position adjustment member regulating an axial position of said roller gear so as to hold said roller gear from axial both sides, while capable of moving said roller gear to a separate position for separating said roller gear and said drive gear from each other in a state of applying no pressing force to said roller gear and to a mesh position for meshing said roller gear and said drive gear with each other in carrying said paper;

a housing provided with an L-shaped hole; and a spring member for inhibiting said position adjustment member from moving from said separate position or said mesh position, wherein said roller mounted with said roller gear is provided movably in the axial direction, said position adjustment member regulates a position of said roller gear so as to hold said roller gear from axial both sides, said position adjustment member includes a body set inside said housing and allowing movement of said roller gear and an operating portion set outside said housing and to be operated by an operator, said position adjustment member is movable vertically and horizontally along said L-shaped hole, and first and second ends of said L-shaped hole correspond to said separate position and said mesh position respectively.

12. The image generating apparatus according to claim 11, wherein said operating portion includes an operating plate to be gripped by the operator.

13. The image generating apparatus according to claim 11, wherein said position adjustment member is movably mounted on said housing by coupling said body and said operating portion with each other through said L-shaped hole.

14. The image generating apparatus according to claim 11, wherein said roller includes a paper feed roller for feeding a paper, and said roller gear includes a paper feed roller gear fixedly mounted on said paper feed roller.

15. The image generating apparatus according to claim 14, wherein said position adjustment member includes a first support portion supporting said paper feed roller gear in a state where said paper feed roller gear meshes with said drive gear.

16. The image generating apparatus according to claim 15, further comprising:

a paper discharge roller; and a paper discharge roller gear meshing with said paper feed roller gear and fixedly mounted on said paper discharge roller, wherein said paper discharge roller gear is so formed as to move following movement of said paper feed roller gear.

17. The image generating apparatus according to claim 16, wherein said position adjustment member includes a second support portion supporting said paper discharge roller gear in a state where said paper feed roller gear meshes with said drive gear.

* * * * *